US005951445A

United States Patent [19]

Vittone et al.

[11] Patent Number: 5,951,445

[45] Date of Patent: Sep. 14, 1999

[54] LEG EXERCISE APPARATUS

[76] Inventors: Larry W. Vittone; Suzanne R. Vittone, both of Rt. 1, Box 55, Hurley, Wis. 54534

[21] Appl. No.: 08/950,207

[22] Filed: Oct. 14, 1997

[51] Int. Cl.[6] ..... A63B 23/04

[52] U.S. Cl. ..... 482/101; 482/80; 482/100; 482/135; 482/138; 482/145

[58] Field of Search ..... 482/51, 52, 76, 482/79, 98, 99, 101, 138, 133–135, 142, 145, 80, 100, 137, 146; 601/29, 35

[56] References Cited

U.S. PATENT DOCUMENTS

| | | | |
|---|---|---|---|
| 2,214,052 | 9/1940 | Good | 482/79 |
| 2,472,391 | 6/1949 | Albizu | 482/133 |
| 2,689,127 | 9/1954 | Silverton et al. | 482/145 |
| 2,720,396 | 10/1955 | Pfaus | 482/79 |
| 3,524,643 | 8/1970 | Hazelitt, Sr. | 482/80 |
| 3,589,720 | 6/1971 | Agamian | 482/135 |
| 4,149,713 | 4/1979 | McLeod | 482/101 |
| 4,169,589 | 10/1979 | McArthur | 482/101 |
| 4,765,615 | 8/1988 | Case | 482/133 |
| 4,915,378 | 4/1990 | Abrahamian et al. | 482/145 |
| 5,260,870 | 11/1993 | Tsuchiya et al. | 482/135 |
| 5,279,530 | 1/1994 | Hess | 482/79 |
| 5,593,374 | 1/1997 | Gvoich | 482/79 |

FOREIGN PATENT DOCUMENTS

| | | | |
|---|---|---|---|
| 1780779 | 12/1992 | U.S.S.R. | 482/98 |

*Primary Examiner*—Richard J. Apley
*Assistant Examiner*—Victor K. Hwang
*Attorney, Agent, or Firm*—Michael E. McKee

[57] ABSTRACT

A multi-station exercise apparatus for use during a leg exercise routine during which the user lies in a supine position and bends his legs at the knees and waist between extended-leg and bent-leg conditions includes a frame and a bench and utilizes two pairs of movable stirrups arranged generally above the bench at opposite ends thereof. The stirrups are adapted to accept the feet of the user as the user lies upon the bench in the supine position and to move with the feet as the legs of the user are bent at the knees and waist between extended-leg and bent-leg conditions. The frame includes two sets of guide rods disposed at each of the opposite ends of the bench for guiding the movement of the two pairs of stirrups generally upwardly and downwardly along predetermined paths as the user selectively moves either the first or second pair of the stirrups with his feet as the feet are moved between the bent-leg and extended-leg conditions. Weight-supporting carriages are connected to each pair of stirrups by way of cable and pulley arrangements for resisting the attempted movement of the user's feet as the user attempts to selectively move either the first or second pair of stirrups upwardly or downwardly with his feet as his feet are moved between the bent-leg and extended-leg conditions.

12 Claims, 7 Drawing Sheets

LEG EXERCISE APPARATUS

BACKGROUND OF THE INVENTION

This invention relates generally to the field of exercise apparatus and relates, more particularly, to exercise apparatus for use during an exercise routine involving the movement of the knees of an individual between extended-leg and bent-leg conditions.

Exercise routines intended to exercise and develop the leg muscles of an individual commonly involve the bending of the legs of the individual at the knees as resistance is applied in opposition to the bending movement. In a common leg-extension apparatus which utilizes a bench upon which a user sits so that his thighs are oriented horizontally and a weight-supporting member pivotally connected to the bench, a user repeatedly raises and lowers the weight-supporting member with his feet as the user moves his legs from a bent condition (at which the feet hang downwardly from the bench) to a straight-leg condition (at which the shins of the user are generally aligned in the horizontal with the user's thighs). In another exercise routine involving the movement of an individual's legs in a curling motion, the individual lies prone upon a bench, maintains the thighs (and knees) of his legs in a stationary position, and then moves his feet between extended-leg conditions and bent-leg conditions in a curling motion as resistance to the curling motion is applied at the feet.

In each of the aforementioned examples of leg extension and leg curl routines, an appreciable amount of stress is exerted upon the user's knees. It is believed that such stress is due, at least in part, to the fixing of the user's knees and thighs in a stationary condition as the legs are moved between bent-leg and straight-leg conditions. In other words, the user's knees are prevented from shifting in position throughout the exercise routine by virtue of the engagement between the thighs and the surface of the bench, and this stationary condition of the thighs effects a concentration of stress (e.g. a shear-related stress) at the knee joints. Furthermore, during use of either of the aforedescribed leg extension and leg curl routines, the work of the user's hamstring muscles is limited. Still further, the performance of the aforementioned leg curling exercise can expose the user's back muscles to undue strain.

It is an object of the present invention to provide a new and improved apparatus for use during the performance of leg exercise routines which prevents the concentration of an appreciable amount of stress upon the user's knees during the leg exercise routines.

Another object of the present invention is to provide such an apparatus which accommodates the performance of both leg extension and leg curl exercises.

Still another object of the present invention is to provide such an apparatus which permits substantial involvement of the hamstring muscles during an exercise routine.

Yet another object of the present invention is to provide such an apparatus which substantially reduces the exposure of the user's back muscles to undue strain during the performance of an exercise routine.

A further object of the present invention is to provide such an apparatus which, during use, exercises the quadricep and hip flexors of the user's legs in an unprecedented manner.

A still further object of the present invention is to provide such an apparatus which is uncomplicated in construction yet effective in operation.

SUMMARY OF THE INVENTION

This invention resides in an exercise apparatus for use during a leg exercise routine wherein at least one of the user's legs are bent at the knee and waist between extended-leg and bent-leg conditions.

The apparatus includes a bench for supporting the user in a supine position thereon and movable stirrup means adapted to accept at least one foot of the user as the user lies upon the bench in the supine position and to move with the at least one foot as the corresponding leg of the user is bent at the knee and waist between extended-leg and bent-leg conditions. Guideway-providing means are associated with the stirrup means for guiding the movement of the stirrup means along a predetermined path as the user moves the at least one foot between the bent-leg and extended-leg conditions, and resistance means are attached to the stirrup means for providing a resistance to attempted movement of the at least one foot as the user attempts to move the at least one foot between the bent-leg and extended-leg conditions. During use of the apparatus, the user's knee is free to move as necessary to relieve the stress effects to which the knee may otherwise be exposed.

DETAILED DESCRIPTION OF AN ILLUSTRATIVE EMBODIMENT

Figure 1:
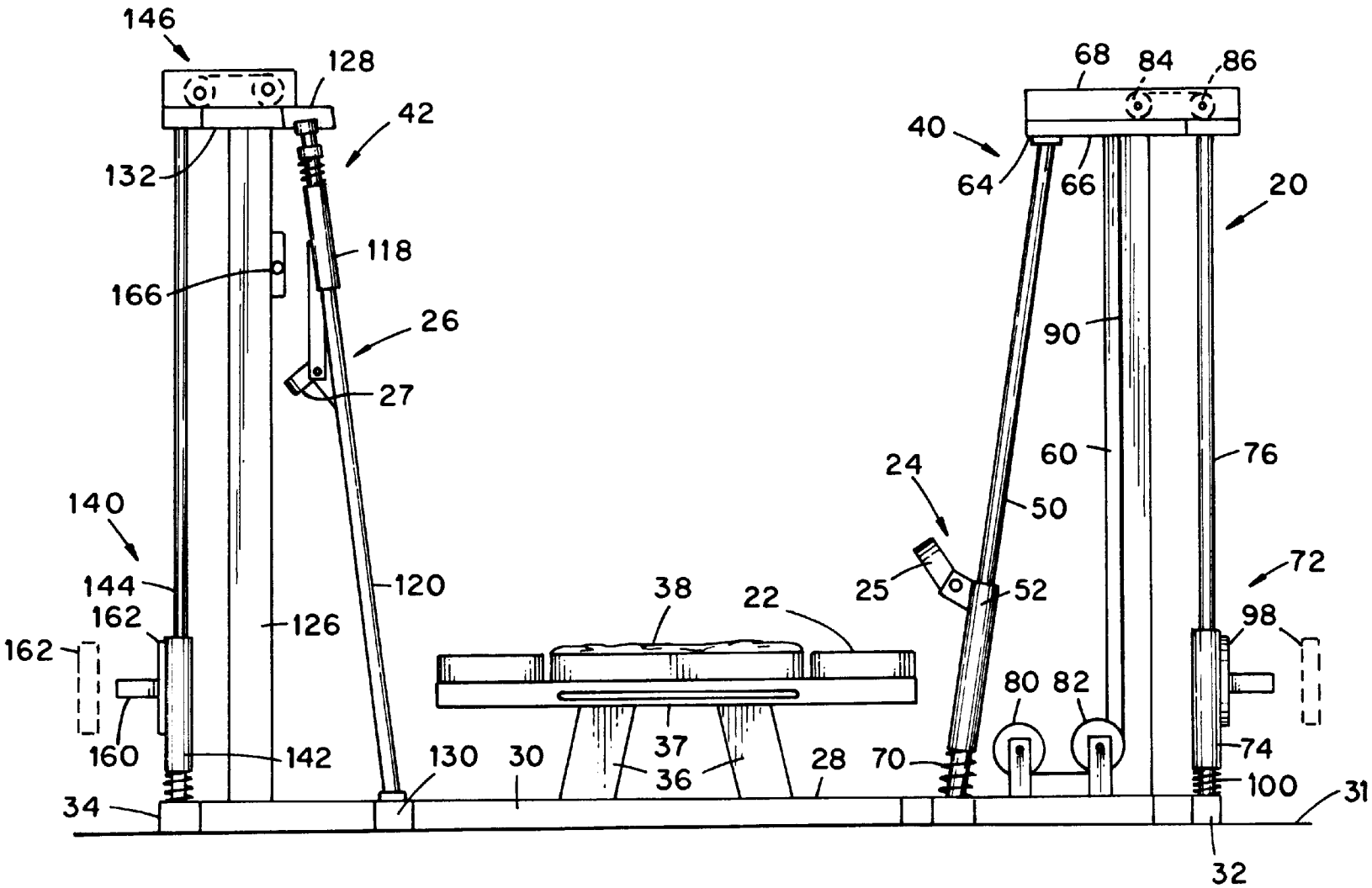
FIG. 1 is a side elevational view of an embodiment of a multi-station exercise apparatus within which features of the invention are embodied.

Turning now to the drawings in greater detail, there is shown in FIG. 1 an embodiment, generally indicated 20, of a multi-station exercise apparatus for use during leg exercise routines involving the bending of the user's legs at the knees and waist between extended-leg and bent-leg conditions. In particular, the apparatus 20 is particularly well-suited for the performance of 1) a leg extension exercise routine involving the forced extension of the legs from a bent-leg condition as the user lies face-up upon his back and attempts to push his feet in a generally upwardly direction against the resistance of weights and 2) a leg curl exercise routine involving the forced contraction of the legs from an extended-leg condition as the user lies face-up upon his back and attempts to pull his feet generally downwardly toward his buttocks against the resistance of weights. To this end, the apparatus 20 includes a bench 22 for supporting a user when lying thereon in supine position (i.e. face-up and upon his back) and two sets of movable stirrup means, generally indicated 24 and 26, disposed on opposite ends of the bench 22 for accepting the feet of the user for the performance of either the aforedescribed leg extension exercise or the leg curl exercise.

Figure 2:
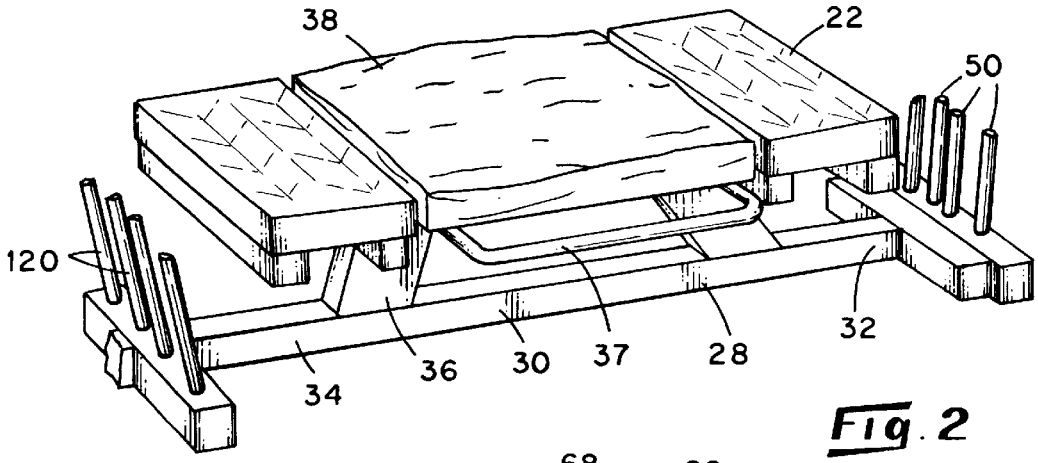
FIG. 2 is a perspective view of a fragment of the FIG. 1 embodiment illustrating the bench section thereof.

With reference to FIGS. 1 and 2, the apparatus 20 includes a frame 28 including an elongated base 30 adapted to rest upon a floor 31 or similar underlying support surface and having two opposite ends 32 and 34 disposed, respectively, upon the rightward and leftward side of the FIG. 1 view. Pedestal-like bracework 36 extends upwardly from the base 30 for supporting the bench 22 in an elevated condition above the floor 31. In the depicted apparatus 20 and as best viewed in FIG. 2, the bench 22 is elongated in shape and generally platen-like in form and is supported by the bracework 36 so that its longitudinal axis extends generally between the ends 32, 34 of the base 30. In addition, a pair of longitudinally-extending handles 37 are rigidly joined along the sides of the bench 22. The bench 22, as well as the major structural components of the apparatus 20, are comprised primarily of steel, although the mid-region of the upper surface of the depicted bench 22 is covered with a relatively soft foam pad 38.

It is a feature of the apparatus 20 that it includes guideway-providing means, generally indicated 40 and 42 in FIG. 1, associated with the frame 28 for guiding the stirrups means 24 and 26, respectively, along predetermined, e.g. generally upward and downward, paths of movement. One of the guiding means 40 is disposed toward the rightward end (as viewed in FIG. 1) of the apparatus frame 28 for guiding the movements of the stirrup means 24 along a near-vertical path during a leg-extension exercise routine, while the other of the guiding means 42 is disposed toward the leftward end (as viewed in FIG. 1) of the apparatus frame 28 for guiding the movements of the stirrup means 26 along a near-vertical path during a leg-curl exercise routine.

Figure 3:
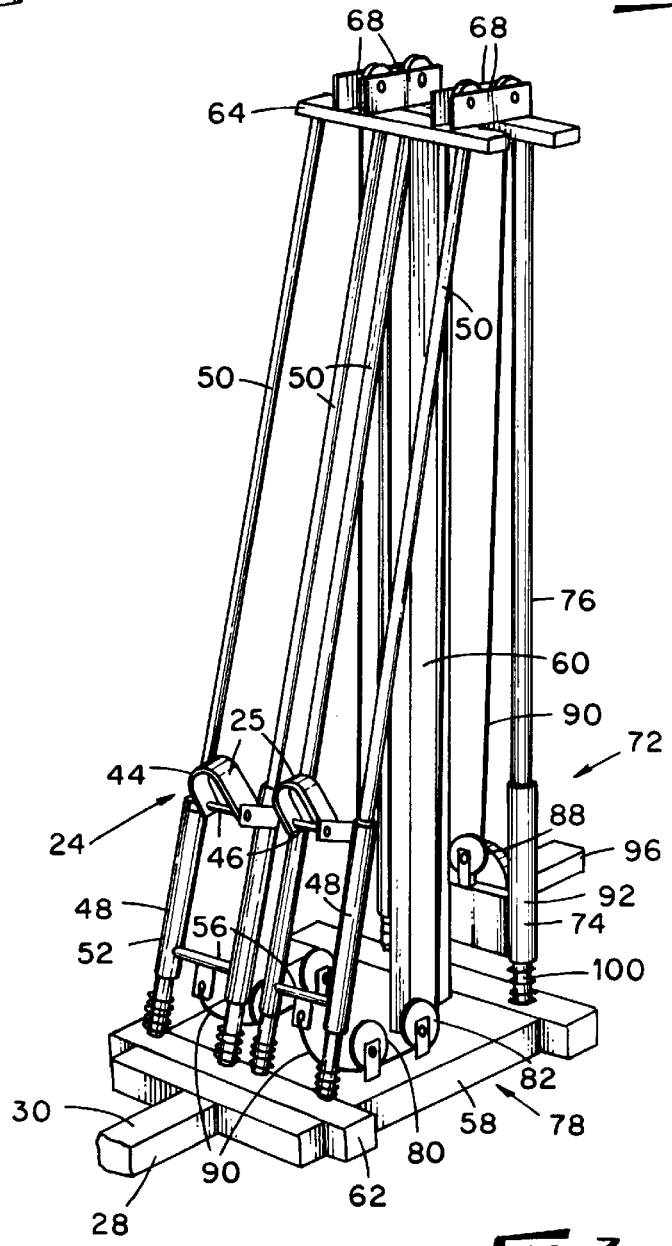
FIG. 3 is a fragmentary perspective view of the rightward, leg-extension portion of the FIG. 1 apparatus.
Figure 4:
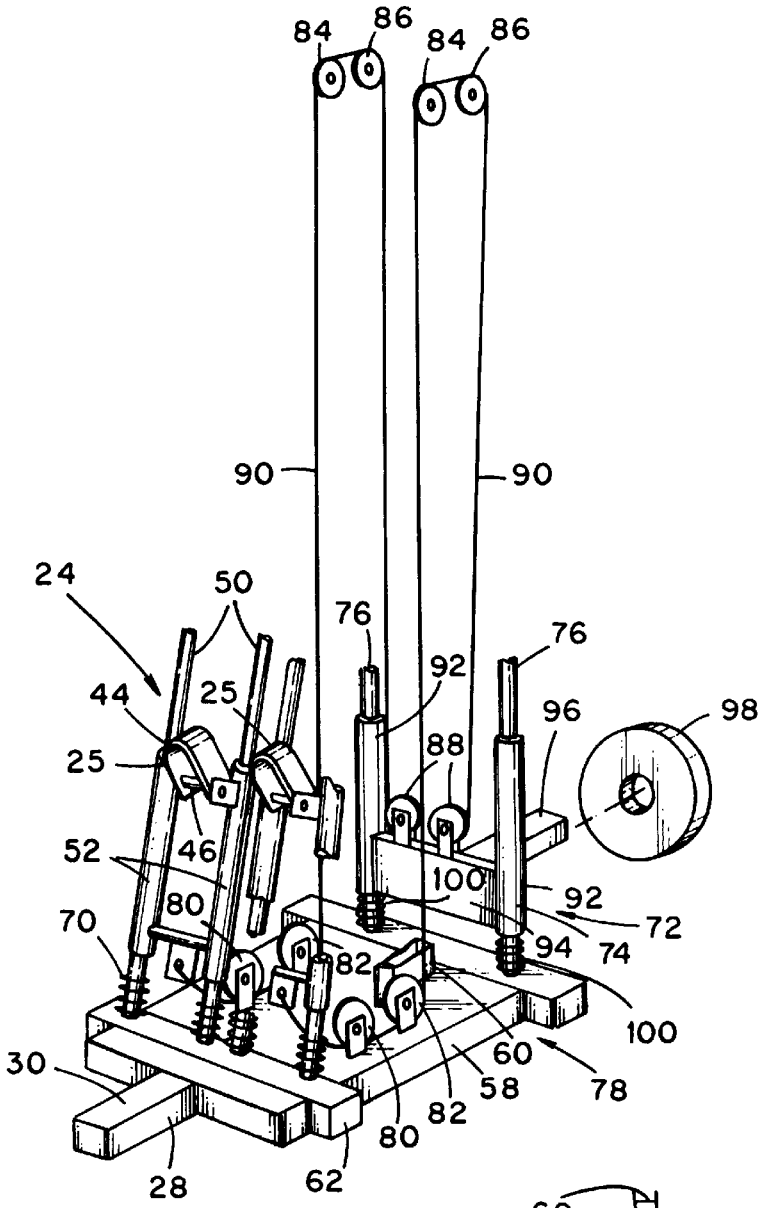
FIG. 4 is a view similar to that of FIG. 3 having sections cut-away to reveal the arrangement of pulleys in the rightward portion of the FIG. 1 apparatus.
Figure 5:
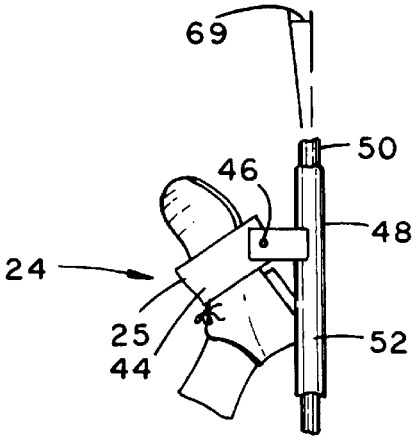
FIG. 5 is a fragmentary side elevational view of the FIG. 1 apparatus depicting a foot of a user when positioned within one of the stirrups of the rightward, leg-extension portion.

With reference to FIGS. 3–5, the stirrup means 24 includes a pair of stirrups 25 wherein each stirrup 25 includes a flexible strap 44, comprised for example of leather or plastic, arranged in the shape of a U and having the legs of its U-shape joined with a transversely-extending pin 46. Collectively, the U-shaped strap 44 and pin 46 define an opening for accepting a foot of a user so that when a foot is accepted toe-end-first by the stirrup opening (and as viewed in FIG. 5), the upper portion of the user's foot engages the strap 44 and the arch of the foot engages the pin 46.

For guiding the stirrups 25 along the predetermined, near-vertical path of movement, the guideway-providing means 40 includes a pair of stirrup-supporting carriages 48 and a plurality of parallel guide rods 50 upon which the carriages 48 are mounted. Each carriage 48 includes a pair of sleeves 52 slidably positioned about a corresponding pair of guide rods 50 and which are joined together by a strut 56 and the transversely-extending pin 46, introduced earlier, of the stirrup 25. Together, the strut 56 and pin 46 fix the sleeves 52 to one another so that the movement of each stirrup 25 along the guide rods 50 effects the movement of the sleeves 52 of the carriage 48 along the rods 50 as a unitary assembly.

For supporting the guide rods 50 in the desired, near-vertical orientation, the frame 28 includes a platform 58 integrally joined to the base 30 at the rightward end 32 thereof and a post 60 joined to the platform 58 so as to extend generally upwardly therefrom. A pair of transversely-extending members 62, 64 are joined at the opposite (i.e. upper and lower) ends of the guide rods 50 in a manner which maintains the rods 50 in a spaced and parallel relationship. The lower member 62 is joined, as by welding, to the base 30 adjacent the platform 58, and the upper member 64 is joined, as by welding, to the upper end of the post 60 by way of an elevated member 66 (FIG. 1) and two sets of parallel plates 68 welded across the upper member 64, elevated member 66 and the post 60. The guide rods 50 of the depicted embodiment 20 are supported by the aforedescribed post 60 and members 62, 64 and 66 so that the rods 50 form an angle 69 (FIG. 5) of about five degrees with the vertical. To cushion any downward impact of the carriages 48 with the base 30, compression springs 70 are positioned about the rods 50 and between the carriage sleeves 52 and the lower member 62.

The apparatus 20 also includes resistance means, indicated 72 in FIGS. 3 and 4, for resisting the user's attempts to move the carriages 48 upwardly along the guide rods 50. In the depicted apparatus 20, the resistance means 72 includes a weight-supporting carriage 74 mounted for vertical movement along a pair of parallel guide rods 76 and a pulley and cable arrangement, generally indicated 78, which joins the weight-supporting carriage 74 to the stirrups 25 so that forced movement of the stirrups 25 upwardly along the guide rods 50 effects a corresponding movement of the weight-supporting carriage 74 upwardly along the guide rods 76. As best shown in FIG. 4, the cable and pulley arrangement 78 includes a network of ten pulleys 80, 82, 84, 86 and 88 rotatably joined to the frame 28 and includes a single cable 90 which is draped across each of the aforedescribed ten pulleys. Each end of the cable 90 is fixedly joined, as with a set screw and socket arrangement, to a strut 56 of a corresponding stirrup 25.

Two sets of pulleys 80, 82 are rotatably joined to the platform 58, two sets of pulleys 84, 86 are rotatably joined to the upper end of the post 60, and the pulleys 88 are rotatably joined to the weight-supporting carriage 74. More specifically, the pulleys 80 and 82 are rotatably mounted to the platform 58 by way of suitable brackets which support each set of pulleys 80, 82 in aligned relationship and in a vertical orientation for rotation about a horizontal axis, and each set of pulleys 84, 86 are positioned and rotatably mounted between a corresponding set of parallel plates 66 and in aligned relationship for rotation about substantially horizontal axes, and the pulleys 88 are mounted atop the weight-supporting carriage 74 by way of suitable brackets which support the pulleys 88 in an aligned relationship and in a substantially vertical orientation for rotation about a horizontal axis.

As a path is traced along the cable 90 from one of the carriage struts 56 to which the cable 90 is joined, the cable 90 is routed in sequence beneath one set of pulleys 80, 82, then upwardly and across one set of pulleys 84, 86, then downwardly and beneath the pulleys 88, then upwardly and across the other set of pulleys 86, 84, then downwardly and beneath the other set of pulleys 82, 80 to the other carriage strut 56. With the stirrup means 24 attached to the weight-supporting carriage 74 in the aforedescribed manner, the movement of the stirrups 25 upwardly along the guide rods 50 effects a corresponding upward movement of the weight-supporting carriage 74 along the guide rods 76. Furthermore, this stirrup means-to-carriage attachment permits the stirrups 25 to be moved upwardly or downwardly along the rods 50 independently of one another while the weight-supporting carriage 74 moves, as necessary, upwardly and downwardly along the guide rods. This independence of movement between the stirrups 25 permits a user to selectively move the stirrups 25 either in concert with one another or in an alternating fashion (e.g. one-at-a-time) along the length of the guide rods 50 upon which they are mounted.

With reference still to FIGS. 3 and 4, the weight-supporting carriage 74 includes a pair of sleeves 92 which are fixedly joined to one another by way of a bar 94 which extends between the sleeves 92 and a longitudinal member 96 having one end which is fixedly attached to and extends from the bar 94. The member 96 is sized to accept the opening of conventional barbell weights 98 directed thereover. It follows that the amount of weight borne by the weight-supporting carriage 74 can be altered by adding or removing weights from the member 96. To cushion any downward impact of the carriage 74 against the base 30, compression springs 100 are positioned about the guide rods 76 between the carriage sleeves 92 and the base 30.

Figure 6:
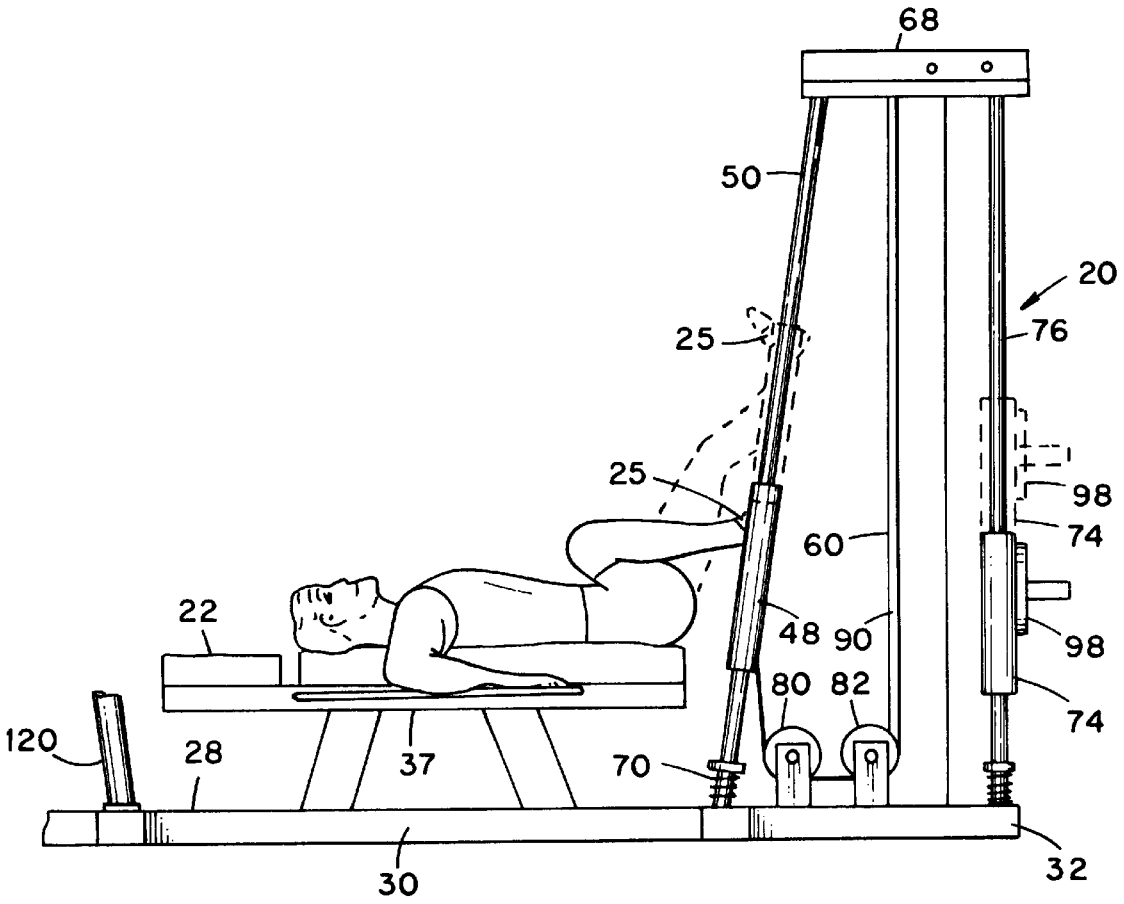
FIG. 6 is a fragmentary side elevational view of the FIG. 1 apparatus wherein the rightward portion thereof is shown being utilized by a user during the performance of a leg extension exercise routine.

To use the rightward, leg-extension portion of the apparatus 20 and with reference to FIG. 6, a user lies upon his back on the bench 22 and inserts his feet, toe-end-first, within the opening of the stirrups 25 so that the upper surfaces of his feet engage the straps 44 (FIG. 5) and the arches of his feet engage the transversely-extending pins 46 of the stirrups 25. With the desired amount of weight positioned upon the carriage 74 (by way of the member 96), the user then urges the carriages 48 by way of the stirrups 25 upwardly along the guide rods 50 from the position illustrated in solid lines in FIG. 6 to the position illustrated in phantom in FIG. 6 as he moves his legs from a bent-leg condition (as depicted in solid lines in FIG. 6) to an extended leg condition (as depicted in phantom in FIG. 6). Of course, as the carriages 48 are moved upwardly along the guide rods 50, the weight-supporting carriage 74 is moved upwardly along the guide rods 76 (by way of the cable and pulley arrangement 78) as the weight borne by the weight-supporting carriage 74 gravitationally resists the upward movement of the carriages 48 by the user. The carriages 48 (by way of the stirrups 25) are subsequently lowered to the FIG. 6 solid-line position as the weight-supporting carriage 74 is permitted to move downwardly along the guide rods 76. The stirrups 25 are thereafter raised and lowered between the FIG. 6 solid-line and the FIG. 6 phantom-line positions for a desired number of repetitions to complete the leg-extension exercise routine. During the performance of such an exercise routine, the user can hold onto the handles 37 of the bench 22 for stability.

Preferably, the stirrups 25 are disposed in such a relationship with respect to the bench (i.e. low enough) so that during an initial phase of the stirrup-lifting action, the stirrups 25 are raised as the upper surface of the user's feet are urged upwardly against the straps 44. Upon lifting the stirrups 25 to a sufficiently-high elevation (e.g. about one-half the length of travel along the guide rods 50), the feet are appropriately shifted to pivot the straps 44 downwardly relative to the pins 46 and to re-position the user's heels in a hooked relationship beneath the pins 46 as best shown in FIG. 5. With the stirrups 25 and feet oriented in this manner, the stirrups 25 are lifted in an action simulating a leg pressing operation as the arches of the feet are urged upwardly against the pins 46.

As mentioned earlier, the movement of each stirrup 25 along its corresponding guide rods 50 is independent of the movement of the other stirrup 25 along its corresponding guide rods 50 so that one stirrup 25 can be moved upwardly along the guide rods 50 while the other stirrup 25 is moved downwardly along the rods 50. Alternatively, one stirrup 25 can be held in stationary position (or not used at all, if the user decides to not place his foot in one of the stirrups 25) while the user raises and lowers the other stirrup 25 in an effort to exercise only one of his legs. In either event, the independence of movement between the stirrups 25 accommodates the performance of a variety of leg extension routines, and the apparatus 20 is advantageous in this respect.

The rightward, leg-extension portion of the apparatus 20 is also advantageous for the range of muscles exercised by the user. In particular, a leg extension routine performed with the apparatus 20 works the user's muscles from the bottom, or base, of the quadriceps all the way up through the hip flexors in a manner not achieved by conventional leg exercise machines. Moreover, by lying on one's back and moving the load upwardly by way of the stirrups 25 so that the user's knees are permitted to move (i.e. float) freely as necessary (e.g. either forwardly, rearwardly, upwardly or toward the left side or right side of the user) eliminates the negative effect that the user would otherwise experience when his knees begin to straighten and move to a near lockout position on conventional leg extension apparatus. In other words, since the knees are not fixed in position as the stirrups 25 are raised and lowered along the guide rods 25, the knees are less likely to experience shear-related stress effects during the exercise routine.

As mentioned earlier and with reference to FIGS. 7 and 8, the leftward, leg-curl portion of the apparatus 20 includes guideway-providing means 42 for guiding the movement of the stirrup means 26 along a predetermined, e.g. generally upwardly and downwardly, path of movement as the user attempts to move his feet from an extended-leg condition to a bent-leg condition. In this connection and with reference to FIGS. 7–10, the stirrup means 26 includes a pair of stirrups 27 including a pair of flexible straps 110 arranged in the shape of a U and having legs which are joined to a transversely-extending sleeve 112 by way of a pair of parallel linkage members 114. The sleeve 112 is slidably positioned about a pin 116 whose purpose will become apparent herein. Together, the stirrups 27 provide a receptacle for accepting the heel of a user's foot when positioned therein as shown in FIG. 10.

The guideway-providing means 42 includes a pair of stirrup-supporting carriages 118 to which the stirrups 27 are attached and two sets of parallel guide rods 120 which confine the movement of the carriages 118 generally along upward and downward, albeit near-vertical, paths. In this connection, each carriage 118 includes a pair of sleeves 122 which are slidably positioned about a corresponding pair of guide rods 120 and a transversely-extending strut 124 which joins, along with the pin 116, the sleeves 122 in a fixed relationship with one another so that movement of the stirrups 27 along the guideway-providing means 42 effects the movement of the carriage sleeves 122 in concert along the guide rods 120 as a unitary assembly.

Figure 10:
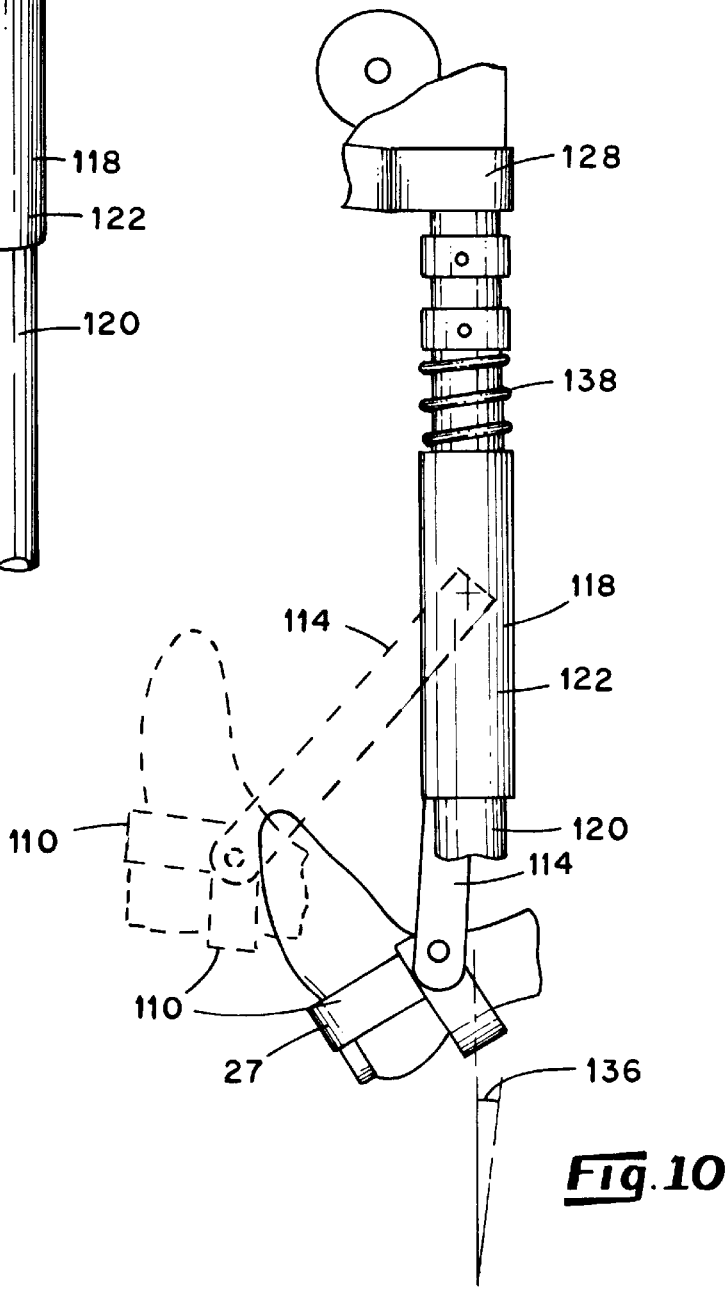
FIG. 10 is a side elevational view of the FIG. 9 fragment as seen generally from the right in FIG. 9 and depicting a foot of a user when positioned within the stirrup of the FIG. 9 fragment.

Because the transversely-extending sleeve 112 is slidably positioned about the pin 116, each stirrup 27 is pivotally connected to its corresponding carriage 118 for movement, for example, between the position illustrated in solid lines in FIG. 10 and the position illustrated in phantom in FIG. 10. As will be apparent herein, this permitted pivotal movement of each stirrup 27 relative to its corresponding carriage 118 permits the user to adjust the fore and aft position of his feet relative to the guide rods 120 during an exercise routine.

For supporting the guide rods 120 in the desired, near-vertical orientation, the frame 28 includes a post 126 joined to the base 30 at the rightward end 34 thereof so as to extend generally upwardly therefrom. A pair of transversely-extending members 128, 130 are joined at the opposite (i.e. upper and lower) ends of the guide rods 120 in a manner which maintains the rods 120 in a spaced and parallel relationship. The lower member 130 is joined, as by welding, to the base 30, and the upper member 128 is joined, as by welding, to the upper end of the post 126 by way of an elevated member 132 (FIG. 1) and two sets of parallel plates 134 welded across the upper member 128, elevated member 132 and the post 126. The guide rods 120 of the depicted embodiment 20 are supported by the aforedescribed post 126 and members 128, 130 and 132 so that the rods 120 form an angle 136 (FIG. 10) of about seven degrees with the vertical. To cushion any upward impact of the carriages 118 at the upper end of the rods 120, compression springs 138 are securely positioned about the rods 120 and disposed between the carriage sleeves 122 and the upper member 128.

Figure 7:
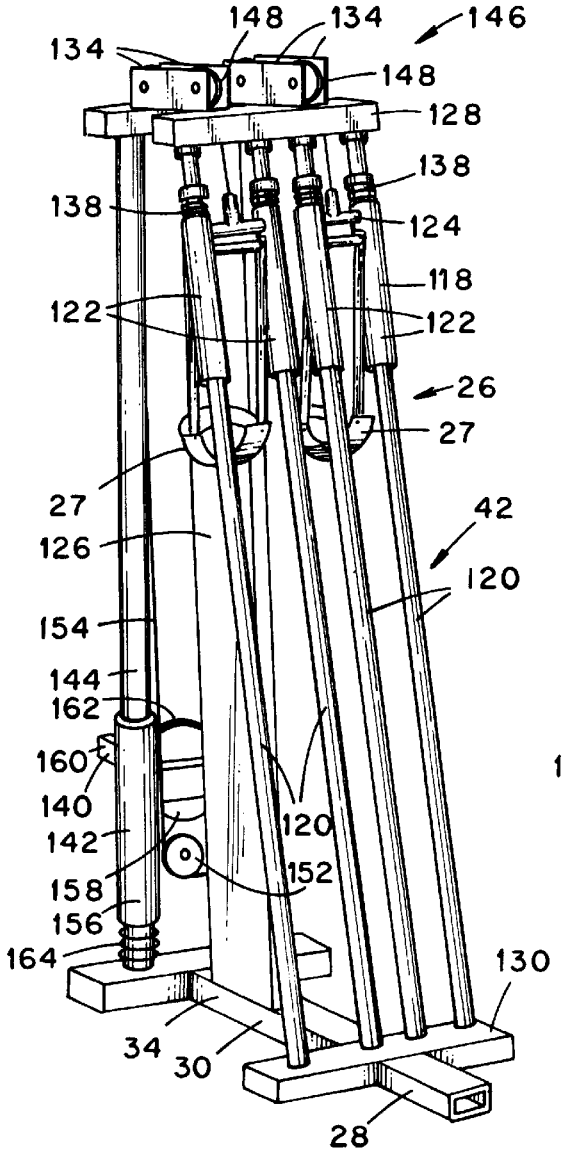
FIG. 7 is a fragmentary perspective view of the leftward, leg-curl portion of the FIG. 1 apparatus.
Figure 8:
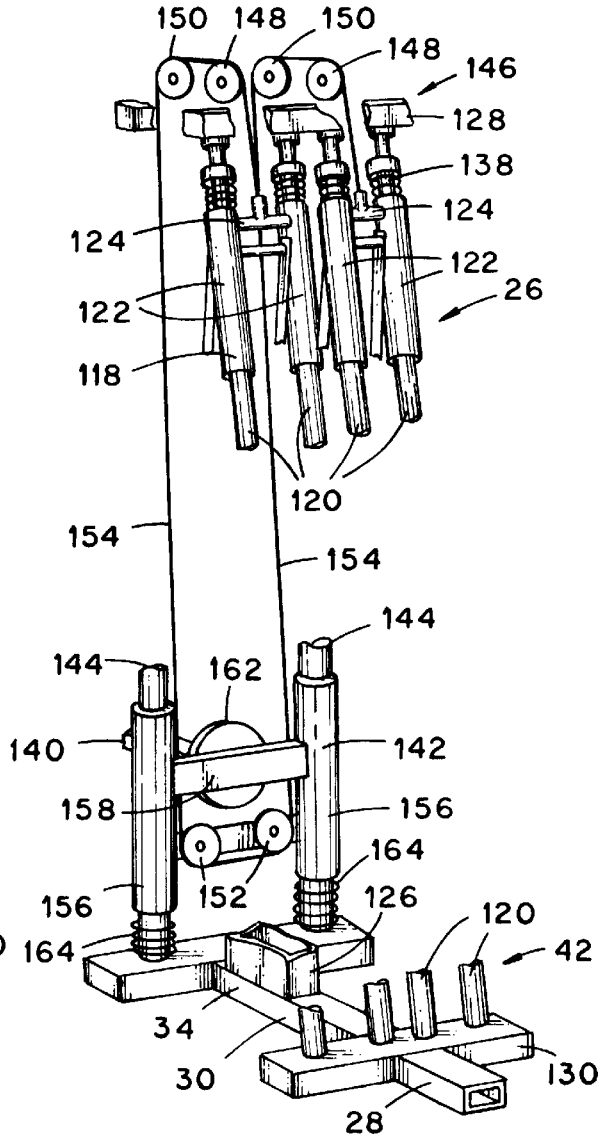
FIG. 8 is a view similar to that of FIG. 7 having sections cut-away to reveal the arrangement of pulleys in the leftward, leg-curl portion of the FIG. 1 apparatus.
Figure 9:
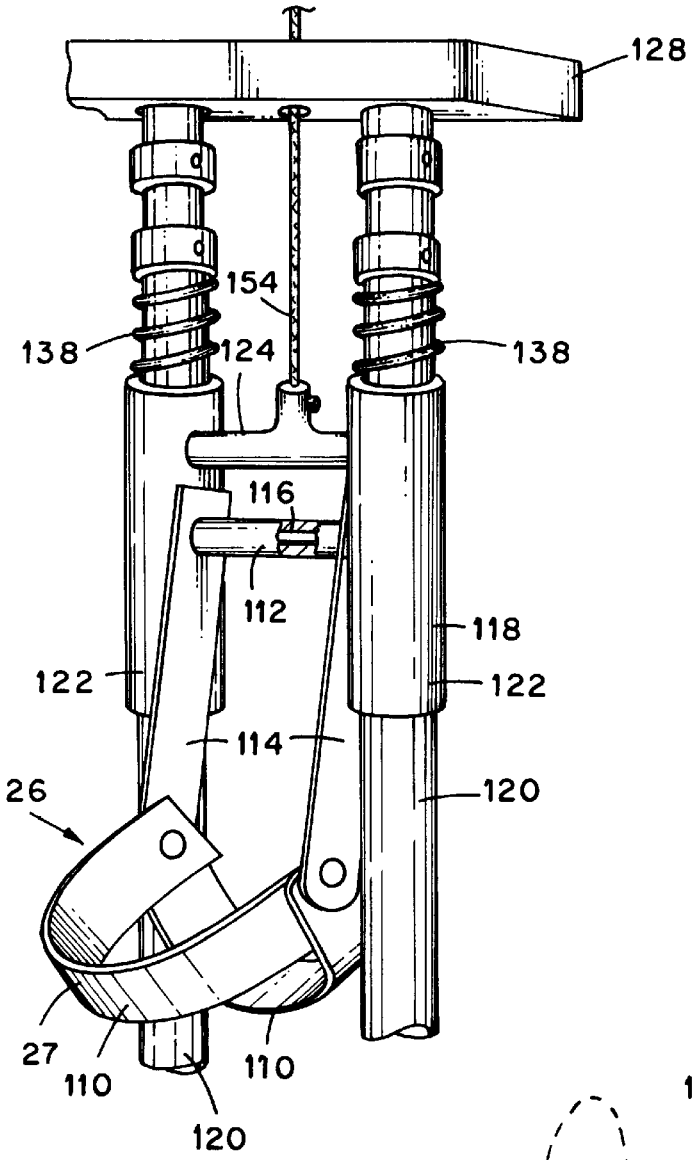
FIG. 9 is a fragmentary perspective view of the leftward portion of the FIG. 1 apparatus illustrating one of the stirrups thereof.

The apparatus 20 also includes resistance means, indicated 140 in FIGS. 7 and 8, for resisting the user's attempts to move the carriages 118 upwardly along the guide rods 120. In the depicted apparatus 20, the resistance means 140 includes a weight-supporting carriage 142 mounted for vertical movement along a pair of parallel guide rods 144 and a pulley and cable arrangement, generally indicated 146, which joins the weight-supporting carriage 142 to the stirrups 27 so that forced movement of the stirrups 27 downwardly along the guide rods 120 effects a corresponding movement of the weight-supporting carriage 142 upwardly along the guide rods 144. As best shown in FIG. 8, the cable and pulley arrangement 146 includes a network of six pulleys 148, 150 and 152 rotatably joined to the frame 28 and includes a single cable 154 which is draped across each of the aforedescribed six pulleys. Each end of the cable 154 is fixedly joined, as with a set screw and socket arrangement, to the strut 124 of a corresponding stirrup 27.

Two sets of pulleys 148, 150 are rotatably joined to the upper end of the post 126 and the pulleys 152 are rotatably joined to the weight-supporting carriage 142. More specifically, each set of pulleys 148, 150 is positioned and rotatably mounted between a corresponding set of parallel plates 134 and in aligned relationship for rotation about substantially horizontal axes, and the pulleys 152 are mounted atop the weight-supporting carriage 142 by way of suitable brackets which support the pulleys 152 in an aligned relationship and in a substantially vertical orientation for rotation about a horizontal axis.

As a path is traced along the cable 154 from one of the carriage struts 124 to which the cable 154 is joined, the cable 154 is routed in sequence upwardly and across one set of pulleys 148, 150, then downwardly and beneath the pulleys 152, then upwardly and across the other set of pulleys 150, 148 to the other carriage strut 124. With the stirrup means 26 attached to the weight-supporting carriage 142 in the aforedescribed manner, the movement of the stirrups 27 downwardly along the guide rods 120 effects a corresponding upward movement of the weight-supporting carriage 142 along the guide rods 144. Furthermore, this stirrup means-to-carriage attachment permits the stirrups 27 to be moved upwardly or downwardly along the rods 120 independently of one another while the weight-supporting carriage 142 moves, as necessary, upwardly and downwardly along the guide rods 144. This independence of movement between the stirrups 27 permits a user to selectively move the stirrups 27 either in concert with one another or in an alternating fashion (e.g. one-at-a-time) along the length of the guide rods 120 upon which they are mounted.

With reference still to FIGS. 7 and 8, the weight-supporting carriage 142 includes a pair of sleeves 156 which are fixedly joined to one another by way of a bar 158 which extends between the sleeves 156 and a longitudinal member 160 having one end which is fixedly attached to and extends from the bar 158. The member 160 is sized to accept the opening of conventional barbell weights 162 directed thereover. It follows that the amount of weight borne by the weight-supporting carriage 142 can be altered by adding or removing weights from the member 160. To cushion any downward impact of the carriage 142 against the base 30, compression springs 164 are positioned about the guide rods 144 between the carriage sleeves 156 and the base 30.

Figure 11:
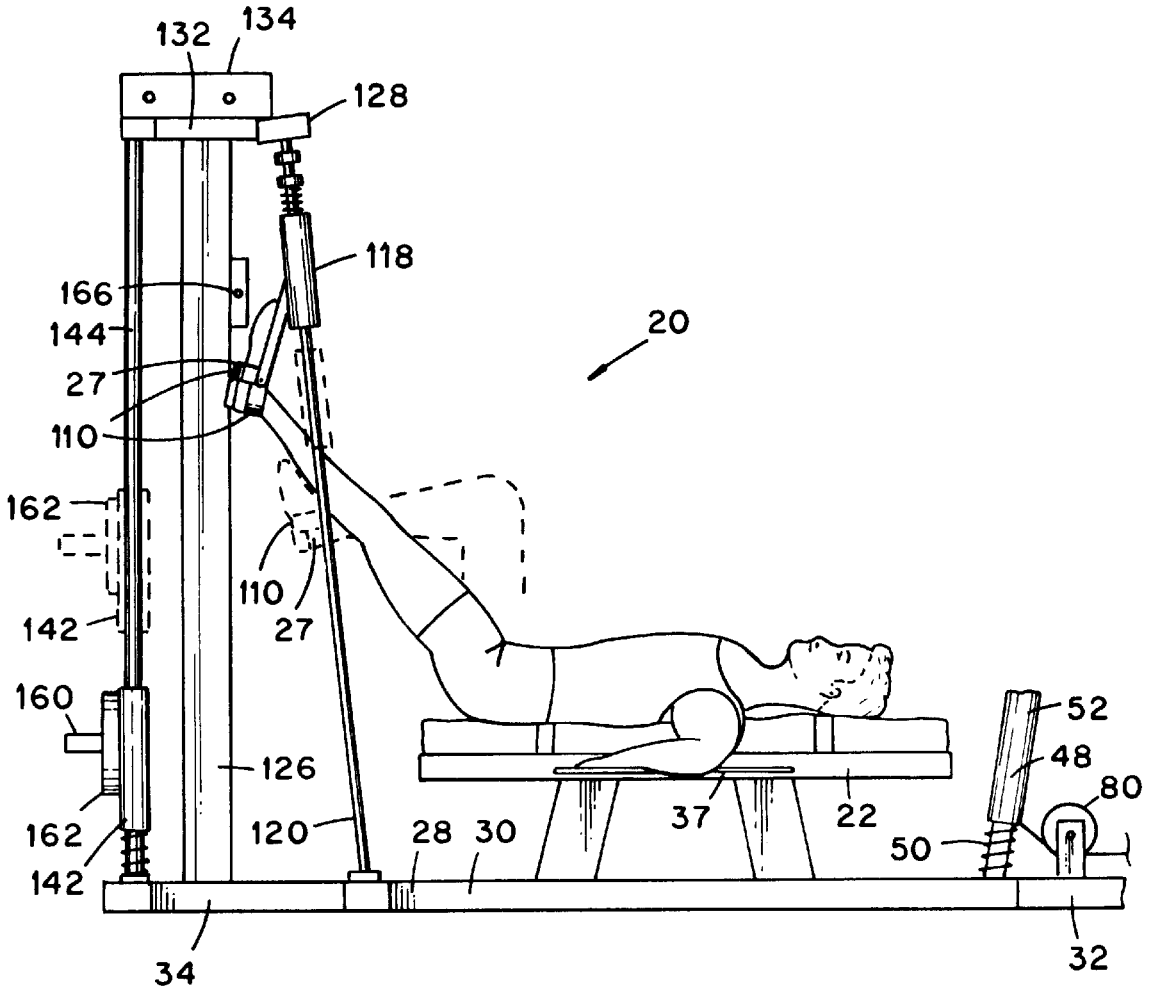
FIG. 11 is a fragmentary side elevational view of the FIG. 1 apparatus wherein the leftward portion thereof is shown being utilized by a user during the performance of a leg curl exercise routine.

To use the leftward, leg-curl portion of the apparatus 20 and with reference to FIG. 11, a user lies upon his back on the bench 22 and inserts his feet, heel-end-first, within the receptacle formed within the stirrups 27 so that the heels of his feet are hooked by the straps 110 of the stirrups 27. With the desired amount of weight positioned upon the carriage 142 (by way of the member 160), the user then urges the carriages 118 with his feet by way of the stirrups 27 downwardly along the guide rods 120 from the position illustrated in solid lines in FIG. 11 to the position illustrated in phantom in FIG. 11 as he moves his legs from an extended-leg condition (as depicted in solid lines in FIG. 11) to a bent-leg condition (as depicted in phantom in FIG. 11). Such an exercise routine bends the user's legs at the knees and waist and moves the feet of the user toward his buttocks to effect a leg curl routine. Of course, as the carriages 118 are moved downwardly along the guide rods 120, the weight-supporting carriage 142 is moved upwardly along the guide rods 144 (by way of the cable and pulley arrangement 146) as the weight borne by the weight-supporting carriage 142 gravitationally resists the downward movement of the carriages 118 by the user. The carriages 118 (by way of the stirrups 27) are subsequently permitted to be raised to the FIG. 11 solid-line position as the weight-supporting carriage 142 is permitted to move downwardly along the guide rods 144. The stirrups 27 are thereafter lowered and raised between the FIG. 11 solid-line and the FIG. 11 phantom-line positions for a desired number of repetitions to complete the leg-curl exercise routine. During the performance of such an exercise routine, the user can hold onto the handles 37 of the bench 22 for stability.

As was discussed earlier in conjunction with the rightward, leg-extension portion of the apparatus 20, the movement of each stirrup 27 along its corresponding guide rods 120 is independent of the movement of the other stirrup 27 along its corresponding guide rods 120 so that one stirrup 27 can be moved downwardly along the guide rods 120 while the other stirrup 27 is moved upwardly along the rods 120. Alternatively, one stirrup 27 can be held in stationary position (or not used at all, if the user decides not to place his foot within one of the stirrups 27) while the user lowers and raises the other stirrup 27 in an effort to exercise only one of his legs. In either event, the independence of movement between the stirrups 27 accommodates the performance of a variety of leg curl routines, and the apparatus 20 is advantageous in this respect.

Furthermore, the permitted pivotal movement of each stirrup 27 relative to the carriages 118 permits the user to shift his feet fore and aft between a forward position, as depicted in phantom in FIG. 10, and a rearward position, as illustrated in solid lines in FIG. 10, during the performance of a leg curl routine. Such a permitted movement of the user's feet is believed to reduce the exposure of the user's knees to undue stress that he may otherwise experience if his feet were strictly confined along a near-vertical path during the leg curl routine. In the depicted apparatus 20, each linkage member 114 associated with the stirrups 27 is at least about twelve inches long thereby providing a broad range of fore and aft pivotal movement of the feet when the feet are positioned within the stirrups 27. If desired and as best shown in FIG. 1, a stop member 166 can be mounted upon the post 126 to limit the forward movement of the stirrups 27 when positioned adjacent the upper limit of travel along the guide rods 120.

The leftward, leg-curl portion of the apparatus 20 is also advantageous for the range of muscles exercised by the user. More specifically, while conventional leg curl exercise routines commonly require that the knees of an individual remain in a fixed or stationary position during the performance of the exercise routine (which consequently limits the work expended by the hamstrings), a leg curl routine performed with the apparatus 20 works the hamstring muscles of the user by an appreciable amount. Moreover, by lying on one's back and moving the load downwardly by way of the stirrups 27 in the intended manner, the user's knees are permitted to float and thus move freely as necessary (e.g. either forwardly, rearwardly, downwardly or toward the left side or right side of the user) to relieve the stress effects to which the knees may otherwise be exposed. Still further, the use of the apparatus 20 for the performance of leg curl exercises reduces the likelihood of back strain that an individual may otherwise experience with conventional leg curl apparatus.

It follows from the foregoing that an exercise apparatus 20 has been described which employs a bench 22 and a leg extension station and a leg curl station disposed on opposite ends of the bench 22. Each station includes a pair of movable feet-accepting stirrups 25 or 27 and guideway-providing means 40 or 42 which guide and confine the movement of the stirrups 25 or 27 upwardly along near-vertical paths of movement. In addition, resistance means 72 or 140 including a weight-supporting carriage 74 or 142 gravitationally biases the stirrups 25 or 27 toward an upward or lower limit of travel along the guideway-providing means 40 or 42. During use of the apparatus 20 during the performance of a leg extension routine, the user lies in a supine position upon the bench 22 with his feet in the appropriate set of stirrups 25 and forcibly urges his legs from a bent-leg condition to an extended-leg condition against the gravitational bias of the weight-supporting carriage 74. By comparison, during use of the apparatus 20 during the performance of a leg curl routine, the user lies in a supine position upon the bench 22 with his feet in the appropriate set of stirrups 27 and forcibly urges his legs from an extended-leg condition to a bent-leg condition against the gravitational bias of the weight-supporting carriage 142.

It will be understood that numerous modifications and substitutions can be had to the aforedescribed embodiment without departing from the spirit of the invention. Accordingly, the aforedescribed embodiment is intended for the purpose of illustration and not as limitation.

We claim:

1. An exercise apparatus for use during a leg exercise routine wherein at least one of the user's legs are bent at the knee and waist between extended-leg and bent-leg conditions, the apparatus comprising:

a bench for supporting the user in a supine position thereon;

movable stirrup means adapted to accept at least one foot of the user as the user lies upon the bench in the supine position and which is adapted to move with the at least one foot as the corresponding leg of the user is bent at the knee and waist between extended-leg and bent-leg conditions during a stirrup-lifting operation of a leg exercise routine, the stirrup means including a strap and a transversely-extending pin between which the one foot of the user is positionable so that when the one foot of the user is accepted by the stirrup means, the strap engages the upper surface of the one foot and the transversely-extending pin engages the arch of the one foot;

guideway-providing means associated with the stirrup means for guiding the movement of the stirrup means substantially upwardly and downwardly along a predetermined path as the user moves the at least one foot between the bent-leg and extended-leg conditions; and resistance means attached to the stirrup means for providing a resistance to attempted movement of the at least one foot as the user attempts to move the at least one foot between the bent-leg and extended-leg conditions and so that as the leg of the user is moved between bent-leg and extended-leg conditions, the user's knee is free to move as necessary to relieve stress effects to which the knee may otherwise be exposed; and the stirrup means is disposed in such an elevational relationship with respect to the bench at the outset of a stirrup-lifting operation so that when the user who lies upon the bench in a supine position with the one foot accepted by the stirrup means attempts to move the stirrup means substantially upwardly from a bent-leg condition to an extended-leg condition during a stirrup-lifting leg exercise routine, the resistance means acts substantially upon the upper surface of the one foot through the strap during an initial phase of a stirrup-lifting operation and the resistance means acts substantially upon the arch of the one foot through the transversely-extending pin during a subsequent stage of the stirrup-lifting operation.

2. The apparatus as defined in claim 1 wherein the resistance means includes a movable weight-supporting carriage and the guideway-providing means is a first guideway-providing means, and the apparatus further includes second guideway-providing means cooperating with the weight-supporting carriage for guiding the movement of the weight-supporting carriage along a generally vertical path, and a cable and pulley arrangement connected between the stirrup means and the weight-supporting carriage so that movement of the stirrup means along the predetermined path effects a corresponding movement of the weight-supporting carriage along said generally vertical path.

3. The apparatus as defined in claim 2 wherein the stirrup means includes a pair of stirrups wherein each stirrup of the pair is adapted to accept a corresponding foot of the user, and the cable and pulley arrangement includes a cable which cooperates between the stirrups and the weight-supporting carriage to accommodate movement of each stirrup along the predetermined path independently of the other stirrup so that one foot of the user can be moved between bent-leg and extended-leg conditions independently of the movement of the other foot of the user between bent-leg and extended-leg conditions.

4. The apparatus as defined in claim 2 wherein the predetermined path of movement along which the stirrup means are guided by the first guideway means is slightly inclined to the vertical so that as the user is supported in the supine position upon the bench and his at least one foot is accepted by the stirrup means, movement of the at least one foot is confined to movement along generally upward and downward paths as the at least one foot is moved between the bent-leg and extended-leg conditions.

5. An exercise apparatus for use during a leg exercise routine during which the user lies in a supine position and bends at least one of his legs at the knee and waist between extended-leg and bent-leg conditions, the apparatus comprising:

a frame;

a bench supported by the frame for supporting the user in a supine position upon the bench;

a pair of movable stirrups arranged generally above the bench wherein each stirrup is adapted to accept a corresponding foot of the user as the user lies upon the bench in the supine position and move with the corresponding foot as the corresponding leg of the user is bent at the knee and waist between extended-leg and bent-leg conditions during a stirrup-lifting operation of a leg exercise routine, each of the movable stirrups including a strap and a transversely-extending pin between which a corresponding foot of the user is positionable so that when the feet of the user are accepted by the stirrup means, the strap of each stirrup engages the upper surface of the corresponding foot and the transversely-extending pin of each stirrup engages the arch of the corresponding foot;

guideway-providing means associated with the frame and cooperating with the stirrups for guiding the movement of each stirrup generally upwardly and downwardly along a predetermined path as the user moves the stirrups with his feet as the feet are moved between the bent-leg and extended-leg conditions; and resistance means attached to the stirrups for providing a resistance to attempted movement of the user's feet as the user attempts to move the stirrups upwardly with his feet as his feet are attempted to be moved between the bent-leg and extended-leg conditions during a stirrup-lifting operation and so that as the leg of the user is moved between bent-leg and extended-leg conditions, the user's knee is free to move as necessary to relieve stress effects to which the knee may otherwise be exposed; and the movable stirrups are disposed in such an elevational relationship with respect to the bench at the outset of a stirrup-lifting operation so that when the user who lies upon the bench in a supine position with his feet accepted by the stirrups attempts to move the stirrups substantially upwardly from a bent-leg condition to an extended-leg condition during a stirrup-lifting operation, the resistance means acts substantially upon the upper surfaces of the feet through the straps of the stirrups during an initial phase of a stirrup-lifting operation and the resistance means acts substantially upon the arches of the feet through the transversely-extending pins of the stirrups during a subsequent stage of the stirrup-lifting operation.

6. The apparatus as defined in claim 5 wherein the resistance means includes a movable weight-supporting carriage and the guideway-providing means is a first guideway-providing means, and the apparatus further includes second guideway-providing means cooperating with the weight-supporting carriage for guiding the movement of the weight-supporting carriage along a generally vertical path, and a cable and pulley arrangement connected between the stirrup means and the weight-supporting carriage so that upward or downward movement of the stirrups effects a corresponding movement of the weight-supporting carriage along said generally vertical path.

7. The apparatus as defined in claim 6 wherein the cable and pulley arrangement includes a cable which cooperates between the stirrups and the weight-supporting carriage to accommodate movement of each stirrup along the predetermined path independently of the other stirrup so that one foot of the user can be moved between bent-leg and extended-leg conditions independently of the movement of the other foot of the user between bent-leg and extended-leg conditions.

8. A multiple station exercise apparatus for performing leg exercise routines during which the user lies in a supine position and bends at least one of his legs at the knee and waist between extended-leg and bent-leg conditions, the apparatus comprising:

a frame;

a bench supported by the frame for supporting the user in a supine position upon the bench and having two opposite ends;

a first pair of movable stirrups arranged generally above the bench at one end thereof wherein each stirrup of the first pair is adapted to accept a corresponding foot of the user as the user lies upon the bench in the supine position and move with the corresponding foot as the corresponding leg of the user is bent at the knee and waist between extended-leg and bent-leg conditions;

a second pair of movable stirrups arranged generally above the bench at the end thereof opposite said one end wherein each stirrup of the second pair is adapted to accept a corresponding foot of the user as the user lies upon the bench in the supine position and move with the corresponding foot as the corresponding leg of the user is bent at the knee and waist between extended-leg and bent-leg conditions;

guideway-providing means associated with the frame and cooperating with each pair of stirrups for guiding the movement of each pair of stirrups generally upwardly and downwardly along a corresponding path of movement as the user selectively moves either the first or second pair of the stirrups with his feet as the feet are moved between the bent-leg and extended-leg conditions; and resistance means attached to the first and second pair of stirrups for providing a resistance to attempted movement of the user's feet as the user attempts to move either the first or second pair of stirrups upwardly or downwardly with his feet as his feet are attempted to be moved between the bent-leg and extended-leg conditions and so that as the legs of the user is moved between bent-leg and extended-leg conditions, the user's knees are free to move as necessary to relieve stress effects to which the knees may otherwise be exposed.

9. The apparatus as defined in claim 8 wherein the resistance means includes a first weight-supporting carriage movably supported by the frame for movement relative thereto along a generally vertical path and a second weight-supporting carriage movably supported by the frame for movement relative thereto along a generally vertical path, and the apparatus further includes a first cable and pulley arrangement connected between the first pair of stirrups and the first weight-supporting carriage so that upward or downward movement of the first pair of stirrups effects a corresponding movement of the first weight-supporting carriage relative to the frame, and a second cable and pulley arrangement connected between the second pair of stirrups and the second weight-supporting carriage so that upward or downward movement of the second pair of stirrups effects a corresponding movement of the second weight-supporting carriage relative to the frame.

10. The apparatus as defined in claim 9 wherein each cable and pulley arrangement includes a cable which cooperates between the corresponding pair of stirrups and the corresponding weight-supporting carriage to accommodate movement of one stirrup of each pair of stirrups along a predetermined path independently of the other stirrup of the corresponding pair so that one foot of the user can be moved between bent-leg and extended-leg conditions independently of the movement of the other foot of the user between bent-leg and extended-leg conditions.

11. The apparatus as defined in claim 8 wherein the first pair of stirrups cooperates with the resistance means by way of the first cable and pulley arrangement so that during an exercise routine performed with the apparatus during which the user's feet are accepted by the first pair of stirrups, the user must lift and push the first stirrups upwardly with his feet as the user's feet are moved between the bent-leg condition and the extended-leg condition.

12. The apparatus as defined in claim 8 wherein the second pair of stirrups cooperates with the resistance means by way of the second cable and pulley arrangement so that during an exercise routine performed with the apparatus during which the user's feet are accepted by the second pair of stirrups, the user must pull the second stirrups downwardly with his feet as the user's feet are moved between the extended-leg condition and the bent-leg condition.

* * * * *